United States Patent [19]

Katoh et al.

[11] Patent Number: 4,952,976

[45] Date of Patent: Aug. 28, 1990

[54] COPIER WITH A TONER SUPPLY DEVICE

[75] Inventors: Eiichi Katoh, Yamato; Hitoshi Hoshi, Tokyo, both of Japan

[73] Assignee: Ricoh Company, Ltd., Tokyo, Japan

[21] Appl. No.: 221,337

[22] Filed: Jul. 19, 1988

[30] Foreign Application Priority Data

Jul. 21, 1987 [JP] Japan ..... 62-180084

[51] Int. Cl.[5] ..... G03G 21/00

[52] U.S. Cl. ..... 355/206; 355/246

[58] Field of Search ..... 355/245, 246, 206; 118/689, 690, 691

[56] References Cited

U.S. PATENT DOCUMENTS

| | | | |
|---|---|---|---|
| 4,032,227 | 6/1977 | Hubbard et al. | 355/246 X |
| 4,260,073 | 4/1981 | Baumann | 355/246 X |
| 4,370,053 | 1/1983 | Hirdyamda et al. | 355/245 |
| 4,423,948 | 1/1984 | Kimura et al. | 355/246 |
| 4,647,180 | 3/1987 | Watanabe | 355/246 |
| 4,647,185 | 3/1987 | Takeda et al. | 355/246 X |
| 4,669,856 | 6/1987 | Yamada | 355/246 X |

*Primary Examiner*—Fred L. Braun

*Attorney, Agent, or Firm*—Oblon, Spivak, McClelland, Maier & Neustadt

[57] ABSTRACT

A copier with a toner supply device which includes a toner cartridge. Toner is supplied from the toner cartridge to a hopper section of a developing unit of the copier and from the toner hopper section to a developing section which includes a developing sleeve. The end of toner in the toner hopper is sensed by a toner end sensing mechanism. A switching device is provided which performs an on-off operation as an operation for supplying toner from a new or full toner cartridge proceeds. A controller controls the developing unit, toner end sensing mechanism and switching device to insure good reproductions even before or immediately after the supply of toner.

4 Claims, 10 Drawing Sheets

| FIG. 8B-a |
| --- |
| FIG. 8B-b |

FIG. 8B-a

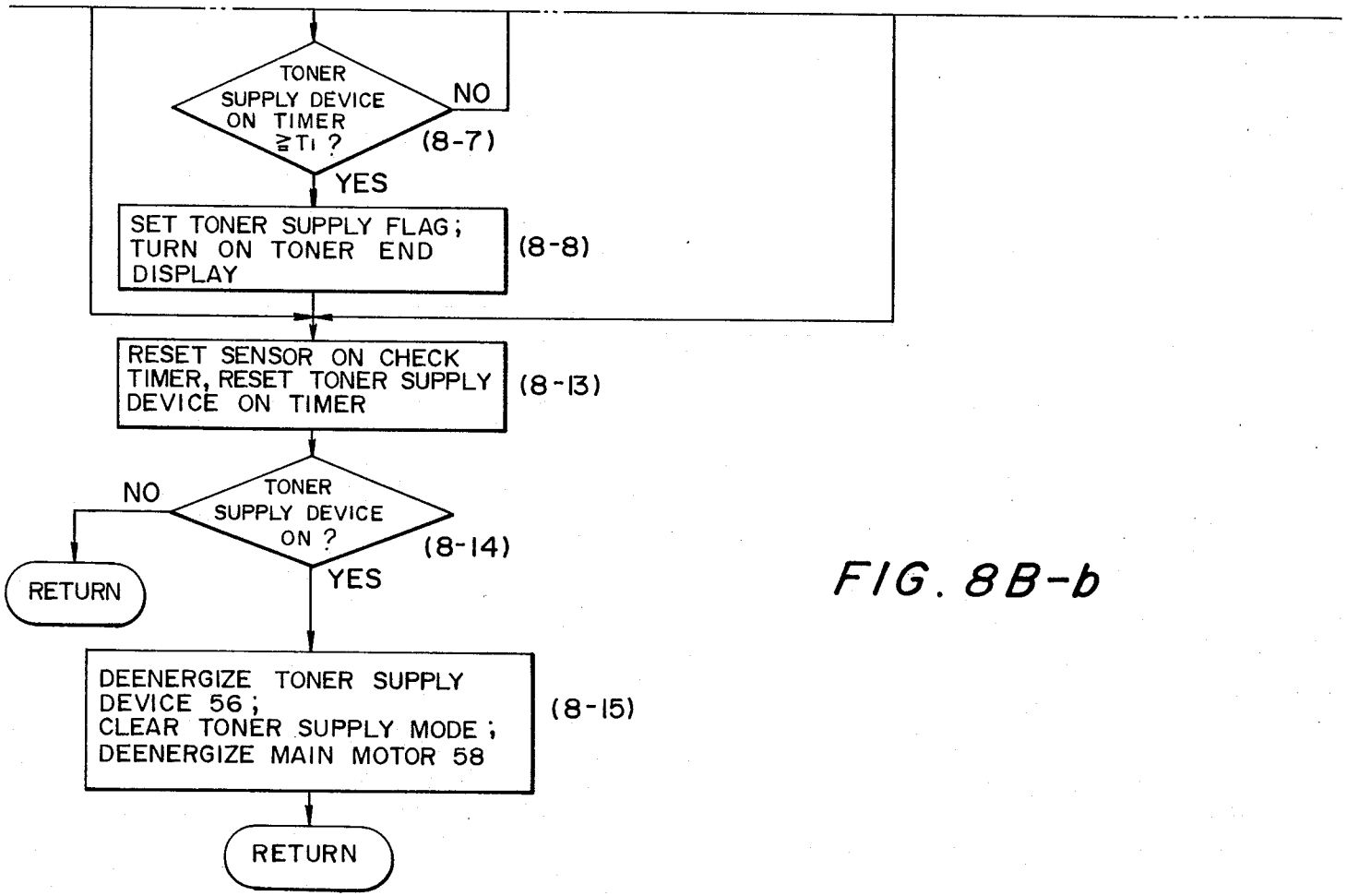
FIG. 8B-b

COPIER WITH A TONER SUPPLY DEVICE

BACKGROUND OF THE INVENTION

The present invention relates to a copier which is equipped with a toner supply device.

A copier having a toner cartridge which is filled with a two-component developer, i.e., a mixture of toner and carrier is extensively used today. In a copier with a toner supply device which includes such a toner cartridge, a control is so performed as to allow a predetermined extra number of copies to be produced even after a toner-end condition has been sensed and then to disable the copier. When a main switch or a front cover of the copier is manipulated after the copier has been disabled, the copier is restored to a condition in which it is ready to produce a predetermined number of copies which may be urgently needed. More specifically, the copier becomes ready to produce copies when the main switch is turned on or off or the front door is opened or closed without the need for supplying toner, i.e., replacing the old or empty toner cartridge with a new or full toner cartridge. This, however, brings about a problem that the density of toner and therefore that of image is sequentially lowered and, in addition, carrier is apt to adhere to a photoconductive element to damage it and/or a cleaning unit.

There has also been known a copier of the type forming an exclusive pattern on a photoconductive element for controlling toner density. In this type of copier, when a decrease in the density of the exclusive pattern beyond a reference level is sensed, it is decided that toner has ended. After a predetermined extra number of copies have been produced in such a toner end condition, the copier is disabled. This type of copier is also brought into a condition for producing a predetermined number of copies after it has been disabled when its main switch or front cover is operated. Such a prior art copier has various drawbacks in addition to those of the previously stated one which does not use an exclusive pattern. Since toner is supplied after toner density has been lowered, the density of reproduced images remains low until the toner density is restored to normal. Since toner density is sensed indirectly, even the fatigue of a photoconductive element, developer and the like, the failure of a charging unit or similar occurrence is sometimes sensed as being representative of the end of toner, resulting in accurate detection.

SUMMARY OF THE INVENTION

It is therefore an object of the present invention to provide a copier with a toner supply device which prevents toner density from being lowered due to the absence of supplementary toner.

It is another object of the present invention to provide a copier with a toner supply device which prevents the density of a developer from being lowered.

It is another object of the present invention to provide a copier with a toner supply device which remains normally operable even before or immediately after the supply of toner.

It is another object of the present invention to provide a generally improved copier with a toner supply device.

In accordance with the present invention, there is provided a copier comprising a developing unit having a developing section, a toner hopper section, and a toner cartridge section, a toner end sensing mechanism for sensing the end of toner in the toner hopper section and producing a toner end signal, a switch turning on and off as a toner supply operation proceeds after the end of toner in the toner hopper section has been sensed, and a control for controlling the developing unit, toner end sensing means and switch such that after the switch has turned on and off toner is fed from the toner cartridge section to the toner hopper section and from the toner hopper section to the developing section and, when the toner end signal from the toner end sensing mechanism stops appearing over a predetermined period of time, the toner supply operation is stopped to restore the copier to a condition for copying.

In accordance with the present invention, there is also provided a copier comprising a developing unit having a developing section, a toner hopper section and a toner cartridge section, a toner end sensing mechanism for sensing the end of toner in the toner hopper section and producing a toner end signal, a switch turning on and off as a toner supply operation proceeds after the end of toner in the hopper section has been sensed, and a control for controlling the developing unit, toner end sensing means and switch such that after the switch has been turned on and off toner is supplied from the toner cartridge section to the toner hopper section and from the toner hopper section to the developing section and, when the toner end signal from the toner end sensing mechanism appears for more than a predetermined period of time, a number of copies producible is changed to a number which is smaller than a number of copies producible in a near toner end condition.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
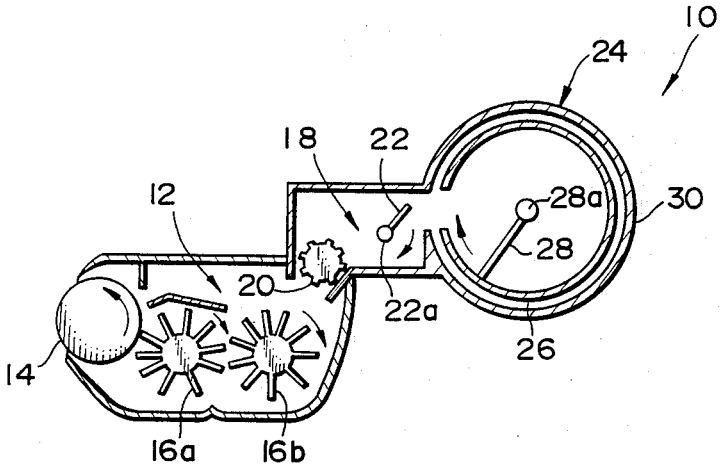
FIG. 1 is a sectional front elevation of a developing unit which is included in a copier with a toner supply device embodying the present invention.

Referring to FIG. 1 of the drawings, a developing unit included in a copier embodying the present invention is shown and generally designated by the reference numeral 10. As shown, the developing unit 10 generally comprises a developing section 12, a toner hopper section 18, and a cartridge section 24. The developing section 12 includes a developing sleeve 14 and paddles 16*a* and 16*b*. The toner hopper section 18 includes a rotatable toner supply shaft 20 and a toner agitator 22 which is rotatable about a shaft 22*a*. Further, the cartridge section 24 includes a cartridge 26 in which an agitator 28 is accommodated to be rotatable about a shaft 28*a*, and a subsection 30 for housing the cartridge 26. The agitator 28 is rotated in synchronism with an electromagnetic toner supply device 56 (see FIG. 3) to convey toner from the cartridge 26 into the toner hopper section 18. Then, the toner agitator 22 in the toner hopper section 18 forces the toner toward the toner supply shaft 20. The toner supply shaft 20 which is rotating drives the toner into the developing section 12.

Figure 2:
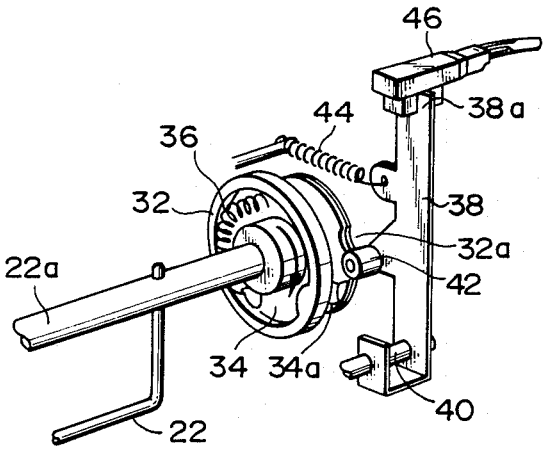
FIG. 2 is a perspective view showing a specific construction of a toner end sensing mechanism.

FIG. 2 shows a specific construction of a toner end sensing mechanism. As shown, a gear 32 having a disk 34 thereinside is mounted on one end of the shaft 22*a* which supports the toner agitator 22. The gear 32 and the disk 34 are interconnected by a spring 36 and respectively formed with recesses 32*a* and 34*a*. An actuator 38 is rotatably supported at its lower end by a shaft 40 and provided with a roller 42. The roller 42 is held in contact with the side walls of the gear 32 and disk 34 where the recesses 32*a* and 34*a* are provided. The actuator 38 is constantly biased by a spring 44 so that the roller 42 remains in pressing contact with the side walls of the disk 34 and gear 32. The tip of the actuator 38 which is remote from the shaft 40 blocks and unblocks an optical path of a toner end sensor 46 depending upon the position of the actuator 38. The actuator 38 generates a toner end signal when its optical path is blocked by the actuator 38, as described in detail hereunder.

The rotating force of the toner agitator 22 depends upon the load which is exerted thereon by toner. Specifically, when toner is present in the toner hopper 18, the toner acts as a load on the toner agitator 22 so that the toner agitator 22 is rotated behind the gear 32 together with the disk 34. In this condition, the recesses 32*a* and 34*a* are constantly deviated from each other to allow the roller 42 of the actuator 38 to roll on the side walls of the disk 34 and gear 32. As the toner in the toner hopper section 18 runs out, the toner agitator 22 is caused to rotate together with the gear 32 because no load acts thereon any longer. This brings the recesses 32*a* and 34*a* into alignment and thereby causes the roller 42 of the actuator 38 to fall into the recesses 32*a* and 34*a*. As a result, the actuator 38 is rotated about the shaft 40 to block the optical path of the toner end sensor 46, the toner end sensor 46 then generating a toner end signal. A display for alerting a person to the end of toner is turned on in response to the toner end signal.

After the toner cartridge 26 has been replaced to supply toner as urged by the display, the toner end condition is not immediately eliminated because toner is not present in the toner hopper section 18. It is therefore necessary to inhibit toner end sensing until the agitator 28 of the cartridge 26 completes one to two full rotations (about 3 seconds) to introduce toner into the toner hopper section 18.

Figure 3:
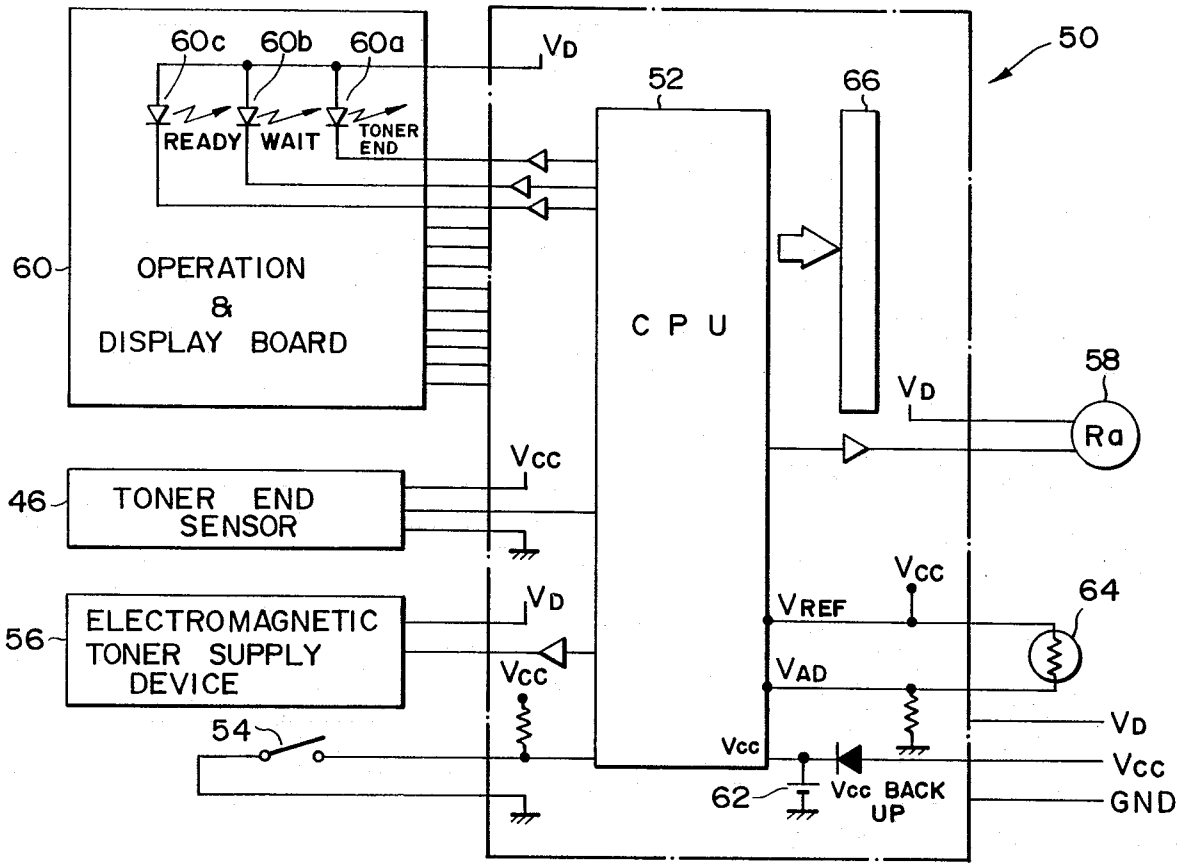
FIG. 3 is a schematic block diagram showing a control system in accordance with the illustrative embodiment.

Referring to FIG. 3, a control system 50 in accordance with the illustrative embodiment is shown and includes a central processing unit (CPU) 52. The inputs to the CPU 52 which are related to this embodiment are an output of the toner end sensor 46 and an output of a door switch 54. Serving as switching means, the switch 54 is actuated when a front door of the copier is opened to replace the cartridge 26, i.e., when the toner end sensing is cleared. The CPU 52 delivers its outputs to the electromagnetic toner supply device 56, a main motor 58 for driving the toner supply device 56, and various displays provided on an operation and display board 60 such as a TONER END display 60*a*, a WAIT display 60*b*, and a READY display 60*c*. A backup battery 62 is connected to a power supply terminal of the CPU 52 to cope with a power-off condition which occurs in the event of toner end. A thermistor 64 associated with a fixing unit is also connected to the CPU 52. In FIG. 3, the reference numeral 66 designates a driver for producing various kinds of load output signals.

Figure 4:
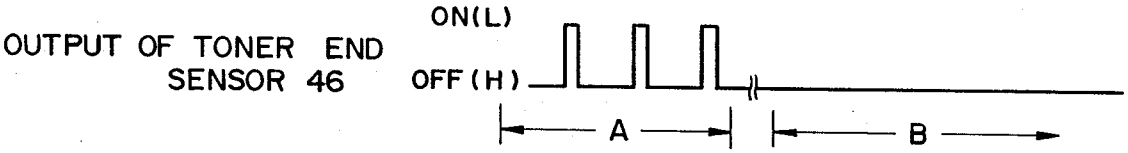
FIG. 4 is a diagram representative of an output waveform of a toner end sensor.

The toner end sensor 46 will be described in more detail hereinafter. The toner end sensor 46 is implemented by a photointerrupter having a light emitting element and a light-sensitive element. The output of the toner end sensor 46 has a low level when a light intercepting member (the tip 38*a* of the actuator 38 shown in FIG. 2) is absent between the two elements and a high level when it is present between the two elements. The toner agitator 22 is rotated only when the toner supply device 56 is activated. The rotation speed of the toner agitator 22 is selected to be 30 rotations per minute so that, in a toner end condition, the roller 42 of the actuator 38 falls in the recesses 34*a* and 32*a* of the disk 34 and gear 32 once per two seconds to turn the output of the toner end sensor 46 into a low level. It is only when the low level output of the toner end sensor 46 has appeared two consecutive times that toner is determined to have run out. FIG. 4 shows an output of the toner end sensor 46 in which A and B are respectively representative of a condition wherein toner has run out, i.e., toner end condition and a condition wherein toner is present.

Figure 5:
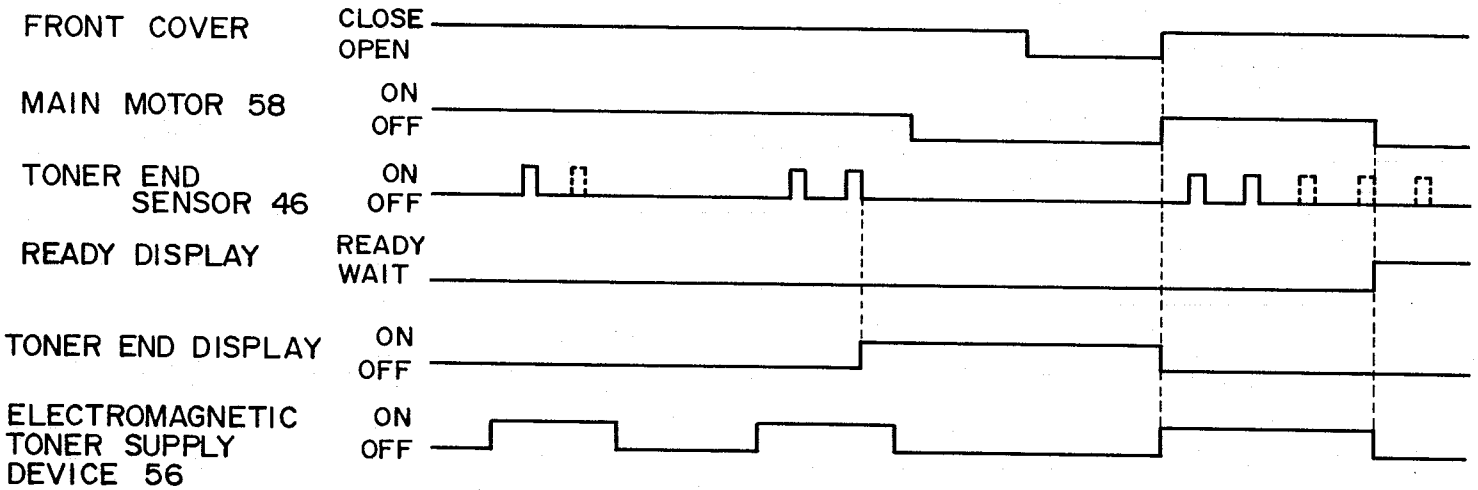
FIGS. 5 and 6 are timing charts.
Figure 6:
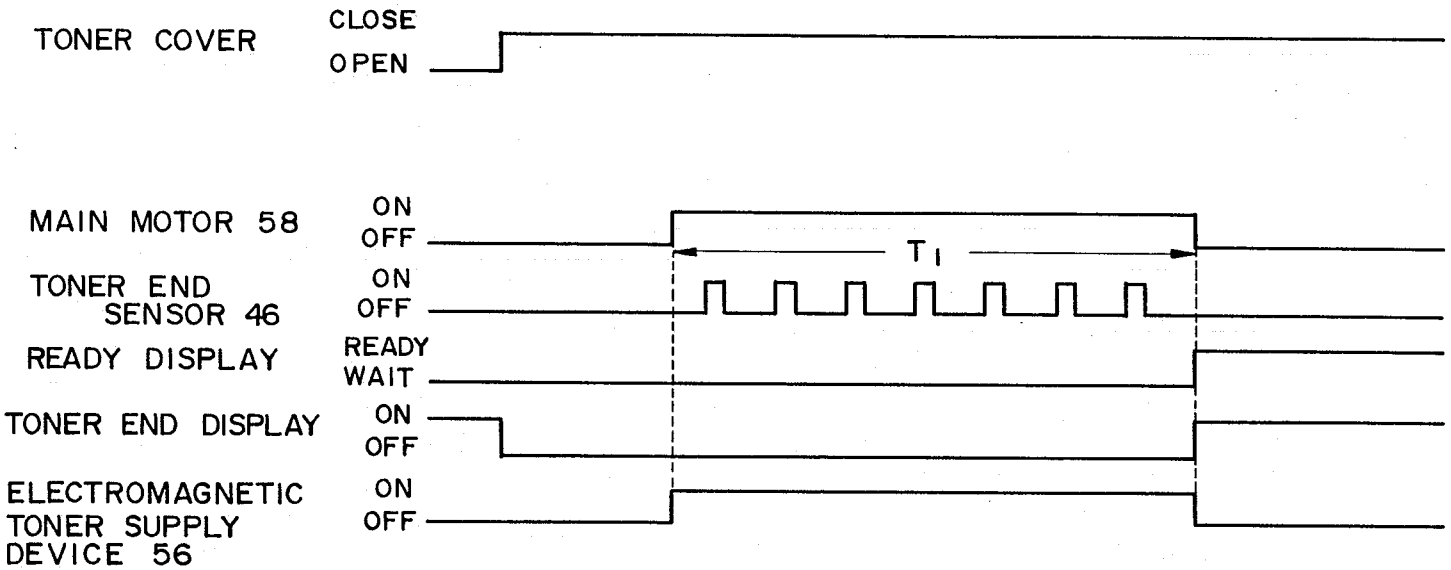

The operation of the illustrative embodiment will be described with reference to FIGS. 5 and 6. After the copier has been disabled due to the end of toner, the TONER END display 60*a* is turned off when the front cover is opened or closed or the power switch is turned off (in this case, backed up by the battery 62). Subsequently, when a warm-up operation for fixing is completed, the main motor 58 and toner supply device 56 are energized. In the initial stage of rotation, toner is not conveyed as far as the toner hopper section 18 and, hence, the toner end sensor 46 becomes ON once per two seconds. As the toner reachs the toner hopper section 18, the toner end sensor 46 does not become ON any longer indicating that toner has been surely supplied. When the toner end sensor 46 does not become ON two consecutive times at its ON timing, it is decided that the toner supply sensing has been completed and, therefore, the main motor 58 and toner supply device 56 are energized and the READY display 60*c* is turned on (see FIG. 5).

On the other hand, when a person manipulates the front cover or the main switch of the copier as previously stated without replacing the cartridge 26, the toner end sensor 46 becomes ON in every two seconds for any length of time even if the main motor 58 is rotated in the same mode as previously stated. In accordance with the illustrative embodiment, the main motor 58 and toner supply device 56 are deactivated and the TONER END dislay 60*a* is turned upon the lapse of a predetermined period of time $T_1$ (e.g. 10 seconds). Although this operation mode which follows toner end should originally inhibit copying, it allows a certain small number of copies to be produced for urgency (see FIG. 6).

Figure 7A:
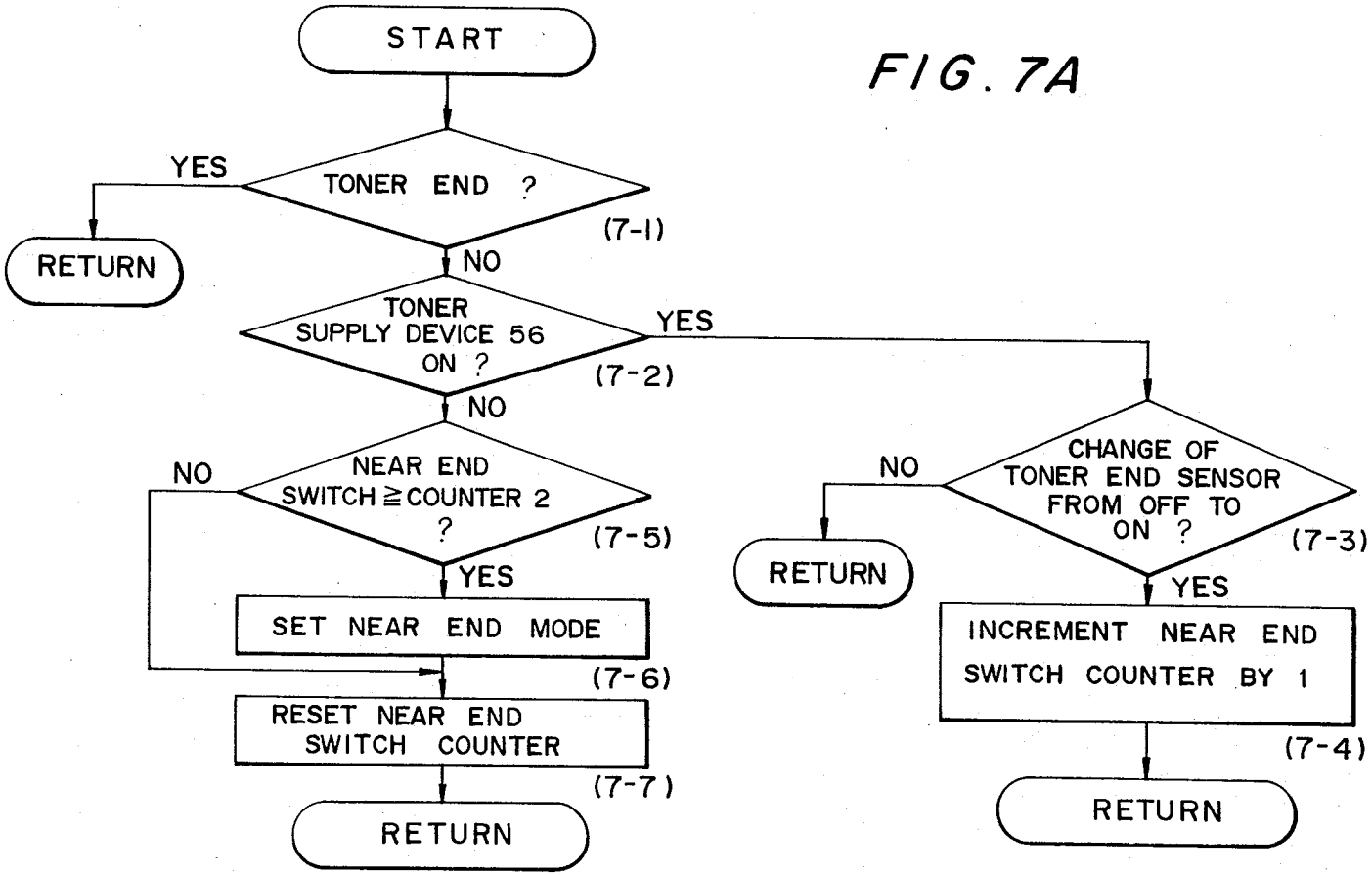
FIGS. 7A, 7B, 8A and 8B are flowcharts.
Figure 7B:
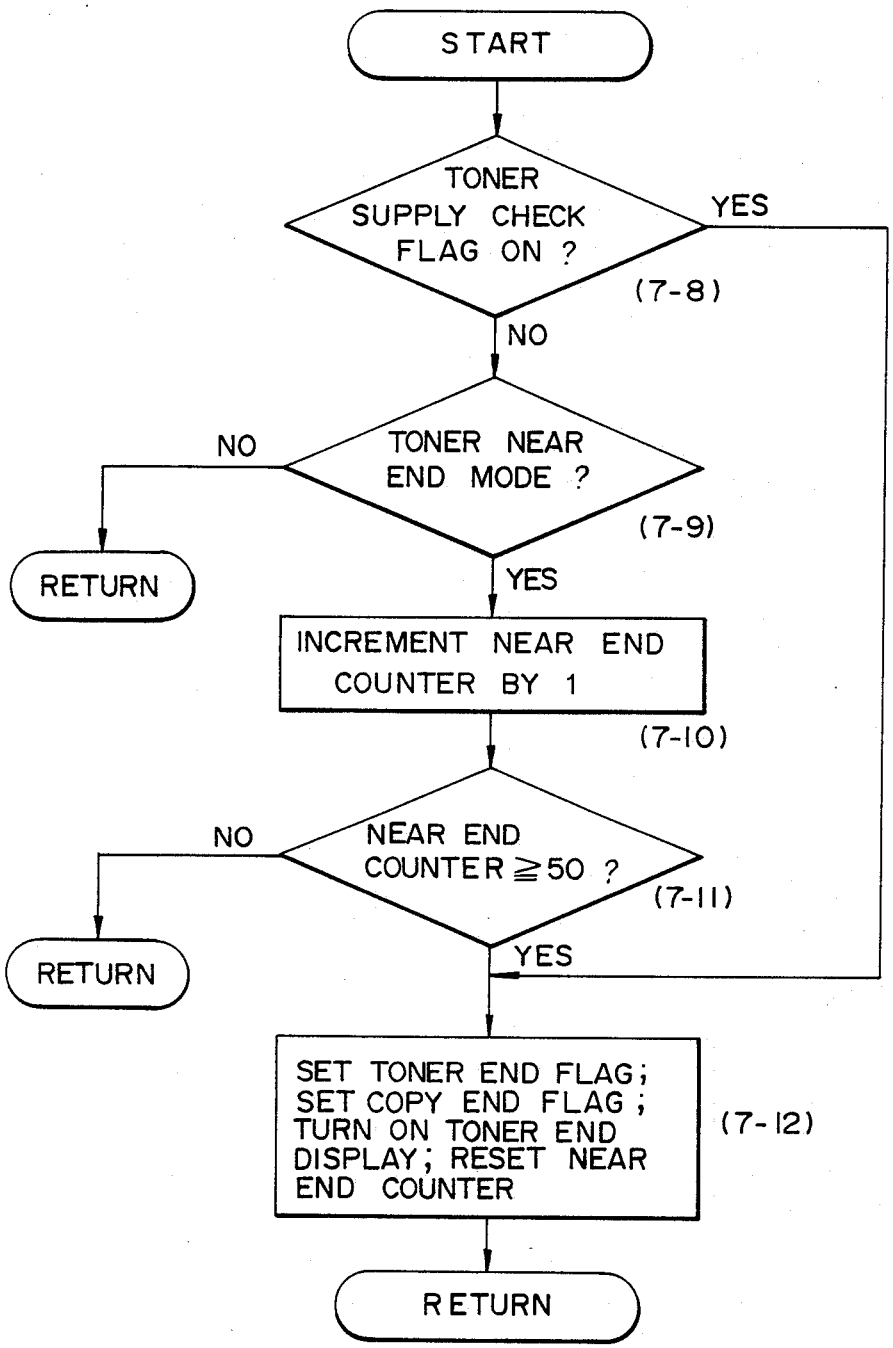

Referring to FIG. 7A, there is shown a flowchart demonstrating how a near end condition is sensed. As shown, assume that a toner end condition has not been reached yet (step 7-1) and the toner supply device 56 is ON (step 7-2). When the toner end sensor 46 changes from an OFF condition to an ON condition (step 7-3), a near end switch counter starts counting such changes (step 7-4). When the toner supply device 56 is OFF (step 7-2) and the near end switch counter is incremented to "2" or above (step 7-5), a near end mode is set up (step 7-6). If the near end switch counter is less than "2" (step 7-5), the near end switch counter is reset (step 7-7). This is followed by a toner near end counter check flow as shown in FIG. 7B. In FIG. 7B, when toner supply is not executed (step 7-8) and a toner near end mode is reached (step 7-9), a near end counter starts counting (step 7-10). As the near end counter is incremented to above "50" (step 7-11), the TONER END display 60a is turned on, the near end counter is reset, and the copier is disabled (step 7-12). In this manner, fifty extra copies may be produced after a near end condition has been reached and before the copier is fully disabled.

Figure 8A:
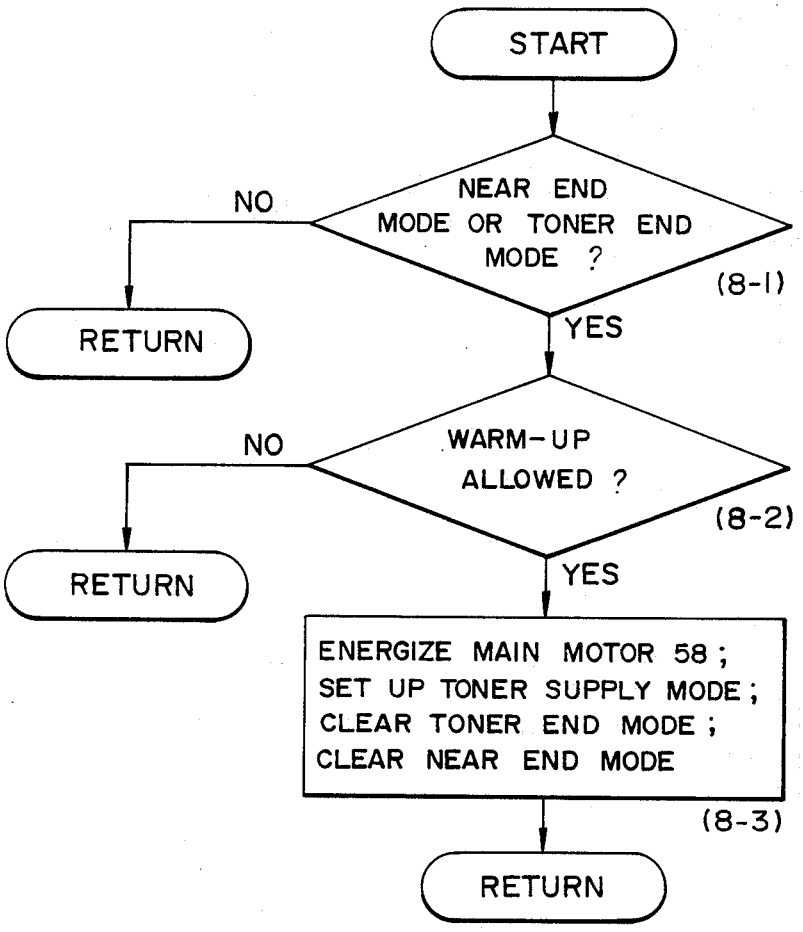
Figure 8B:
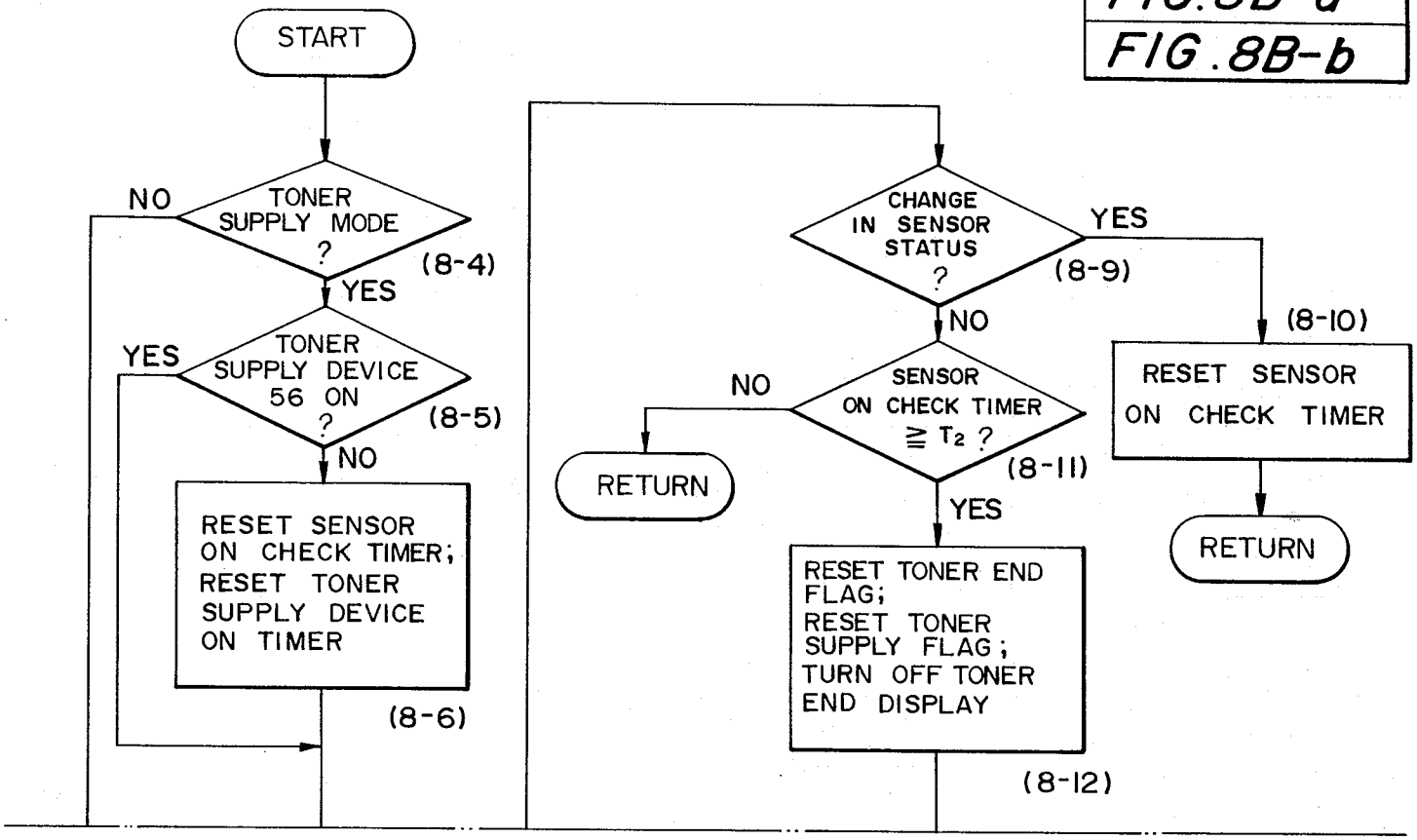
Figure 9:
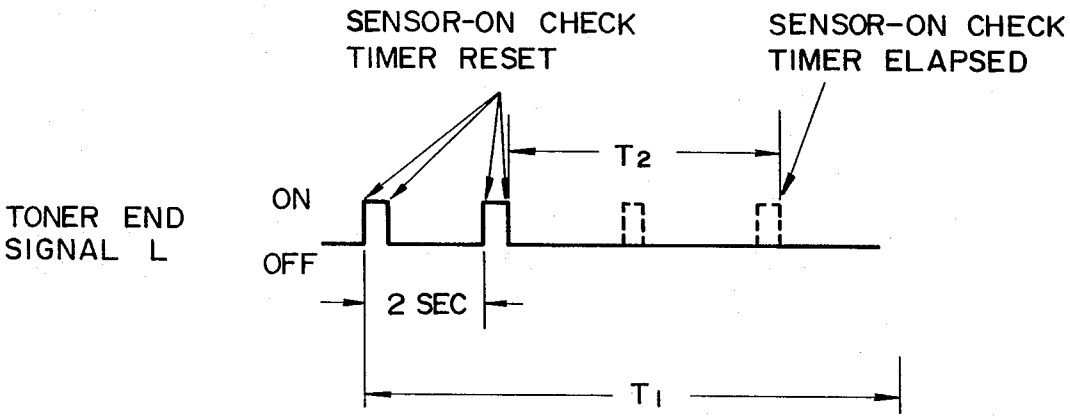
FIG. 9 is a timing chart demonstrating the operation of a timer.

FIG. 8A is a flowchart demonstrating the operation of the main motor 58 which follows the toner end condition. In the toner end mode or the above-described near end mode (step 8-1), if a warm-up operation is allowed (step 8-2), the main motor 58 is energized and a toner supply mode is set with the toner end mode or near end mode reset (step 8-3). This is followed by an end check flow which follows toner end and toner supply, as shown in FIG. 8B. Specifically, if a supply mode has been set (step 8-4) and the toner supply device 56 is ON (step 8-5), the toner supply device 56 is activated and a toner supply device ON timer for determining whether a predetermined period of time has expired after the turn-on of the device 56 is reset (step 8-6). Then, as shown in FIG. 9, even before a sensor ON timer expires, a toner supply check flag is set and the TONER END display 60a is turned on (step 8-8) when the toner supply device ON timer exceeds $T_1$ (10 seconds in the illustrative embodiment) (step 8-7). If the toner supply device ON timer is short of $T_1$ (step 8-7) and the status of the TONER END sensor 46 is changed (step 8-9), the sensor ON check timer is reset. However, if the sensor ON check timer has exceeded $T_2$ (4 seconds in the illustrative embodiment) (step 8-11), the toner end flag and toner supply check flag are reset and the TONER END display 60a is turned off (step 8-12). After the step 8-8 or the step 8-12, the sensor ON check timer and toner supply device ON timer are reset (step 8-13). After the toner supply device 56 has been activated to supply toner, it is deactivated, the toner supply mode is cleared, and the main motor 58 is deenergized (step 8-15).

In summary, it will be seen that the present invention provides a copier with a toner supply device which insures quality reproductions by eliminating various troubles which are apt to occur before or immediately after the supply of toner.

Various modifications will become possible for those skilled in the art after receiving the teachings of the present disclosure without departing from the scope thereof.

What is claimed is:

1. A copier comprising:

a developing unit having a developing section, a toner hopper section, and a toner cartridge section;

toner lack sensing means for sensing lack of toner in said toner hopper section and producing a toner lack signal;

switching means turning on and off as a toner supply operation proceeds after the lack of toner in said toner hopper section has been sensed; and control means for controlling said developing unit, said toner lack sensing means and said switching means such that a near toner end condition is sensed when said toner lack signal is produced and a predetermined extra number of copies is allowed to be produced in said near toner end condition, and that a toner end condition is sensed when said predetermined extra number of copies have been produced in said near toner end condition and then the copier is disabled.

2. A copier comprising:

a developing unit having a developing section, a toner hopper section, and a toner cartridge section;

toner end sensing means for sensing end of toner in said toner hopper section and producing a toner end signal;

switching means turning on and off as a toner supply operation proceeds after the end of toner in said toner hopper section has been sensed; and control means for controlling said developing unit, said toner end sensing means and said switching means such that after said switching means has turned on and off toner is fed from said toner cartridge section to said toner hopper section and from said toner hopper section to said developing section and, when the toner end signal from said toner end sensing means stops appearing over a predetermined period of time, the toner supply operation is stopped to restore said copier to a condition for copying and further such that after said switching means has been turned on and off toner is supplied from said toner cartridge section to said toner hopper section and from said toner hopper section to said developing section and, when the toner end signal from said toner end sensing means appears for more than a predetermined period of time, a number of copies producible is changed to a number which is smaller than a number of copies producible in a near toner end condition.

3. A copier comprising:

a developing unit having a developing section, a toner hopper section and a toner cartridge section;

toner end sensing means for sensing end of toner in said toner hopper section and producing a toner end signal;

switching means turning on and off as a toner supply operation proceeds after the end of toner in said hopper section has been sensed; and control means for controlling said developing unit, said toner end sensing means and said switching means such that after said switching means has been turned on and off toner is supplied from said toner cartridge section to said toner hopper section and from said toner hopper section to said developing section and, when the toner end signal from said toner end sensing means appears for more than a predetermined period of time, a number of copies producible is changed to a number which is smaller than a number of copies producible in a near toner end condition.

4. A copier as claimed in claim 3, wherein said control means further controls said developing unit, said toner end sensing means and said switching means such that after said switching means has turned on and off toner is fed from said toner cartridge section to said toner hopper section and from said toner hopper section to said developing section and, when the toner end signal from said toner end sensing means stops appearing over a predetermined period of time, the toner supply operation is stopped to restore said copier to a condition for copying.

* * * * *